US011175025B2

(12) United States Patent
Fuller et al.

(10) Patent No.: US 11,175,025 B2
(45) **Date of Patent: *Nov. 16, 2021**

(54) UNDERWATER LIGHT DISPLAY DEVICE WITH PROPULSION

(71) Applicant: WET, Sun Valley, CA (US)

(72) Inventors: Mark Fuller, Sun Valley, CA (US); Riae Yoo, Sun Valley, CA (US); Scott Winslow, Sun Valley, CA (US); EunKyoung Kim, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/747,518

(22) Filed: Jan. 20, 2020

(65) Prior Publication Data

US 2020/0292158 A1 Sep. 17, 2020

Related U.S. Application Data

(63) Continuation of application No. 15/438,630, filed on Feb. 21, 2017, now Pat. No. 10,539,305.

(Continued)

(51) Int. Cl.

| | |
|---|---|
| ***F21V 21/15*** | (2006.01) |
| ***H05B 47/19*** | (2020.01) |
| ***F21W 131/401*** | (2006.01) |
| ***F21S 9/02*** | (2006.01) |
| ***F21V 31/00*** | (2006.01) |
| ***F21V 3/02*** | (2006.01) |

(Continued)

(52) U.S. Cl.

CPC ..... *F21V 21/15* (2013.01); *B63B 34/00* (2020.02); *F21L 4/00* (2013.01); *F21S 9/02* (2013.01); *F21V 3/02* (2013.01); *F21V 15/01* (2013.01); *F21V 31/005* (2013.01); *H05B 45/10* (2020.01); *H05B 45/20* (2020.01); *H05B 47/19* (2020.01); *F21W 2121/00* (2013.01); *F21W 2131/401* (2013.01); *F21Y 2113/17* (2016.08); *F21Y 2115/00* (2016.08)

(58) Field of Classification Search

CPC ... F21V 31/005; F21L 4/00; F21L 4/09; F21S 9/02; F21W 2107/00; F21W 2107/20; F21W 2131/401; F21W 2111/04–047

See application file for complete search history.

(56) References Cited

U.S. PATENT DOCUMENTS 4,438,588 A * 3/1984 Martin ..... A63H 33/005 446/154

4,563,626 A * 1/1986 Ohtake ..... A63H 30/00 320/103

(Continued)

*Primary Examiner* — Rajarshi Chakraborty
*Assistant Examiner* — Steven Y Horikoshi
(74) *Attorney, Agent, or Firm* — Maceiko IP

(57) ABSTRACT

A light display system and device for use in a body of water or other liquid is described. The light display device may be controlled remotely via a control hub and/or control panel, or controlled by internally preprogrammed commands. A plurality of light display devices may be controlled in selected, choreographed sequences to provide various unique visual displays including, for example, geometrical patterns and/or naturalistic patterns giving the impression of organic phenomena such as swarming fireflies, bioluminescent creatures and the like.

20 Claims, 10 Drawing Sheets

Related U.S. Application Data

(60) Provisional application No. 62/297,786, filed on Feb. 19, 2016.

(51) Int. Cl.

| | |
|---|---|
| ***F21L 4/00*** | (2006.01) |
| ***F21V 15/01*** | (2006.01) |
| ***H05B 45/10*** | (2020.01) |
| ***H05B 45/20*** | (2020.01) |
| ***B63B 34/00*** | (2020.01) |
| *F21Y 115/00* | (2016.01) |
| *F21Y 113/17* | (2016.01) |
| *F21W 121/00* | (2006.01) |

(56) References Cited

U.S. PATENT DOCUMENTS

| | | | | |
|---|---|---|---|---|
| 6,238,067 | B1 * | 5/2001 | Hirsch | A63H 27/10 362/231 |
| 6,280,277 | B1 | 8/2001 | Greenberg et al. | |
| 7,017,911 | B1 | 3/2006 | Chia | |
| 9,738,360 | B2 * | 8/2017 | Habeger | B63G 8/001 |
| 10,539,305 | B2 * | 1/2020 | Fuller | F21S 9/02 |
| 2002/0083880 | A1 * | 7/2002 | Shelton | B63G 8/001 114/312 |
| 2002/0089297 | A1 * | 7/2002 | Filo | B62D 57/022 318/568.12 |
| 2002/0179728 | A1 * | 12/2002 | Beidokhti | B05B 17/08 239/20 |
| 2008/0057822 | A1 | 3/2008 | Curtis et al. | |
| 2013/0107507 | A1 * | 5/2013 | Tucker | F21V 23/0435 362/190 |
| 2016/0091895 | A1 * | 3/2016 | Hed | A63H 17/36 701/2 |

* cited by examiner

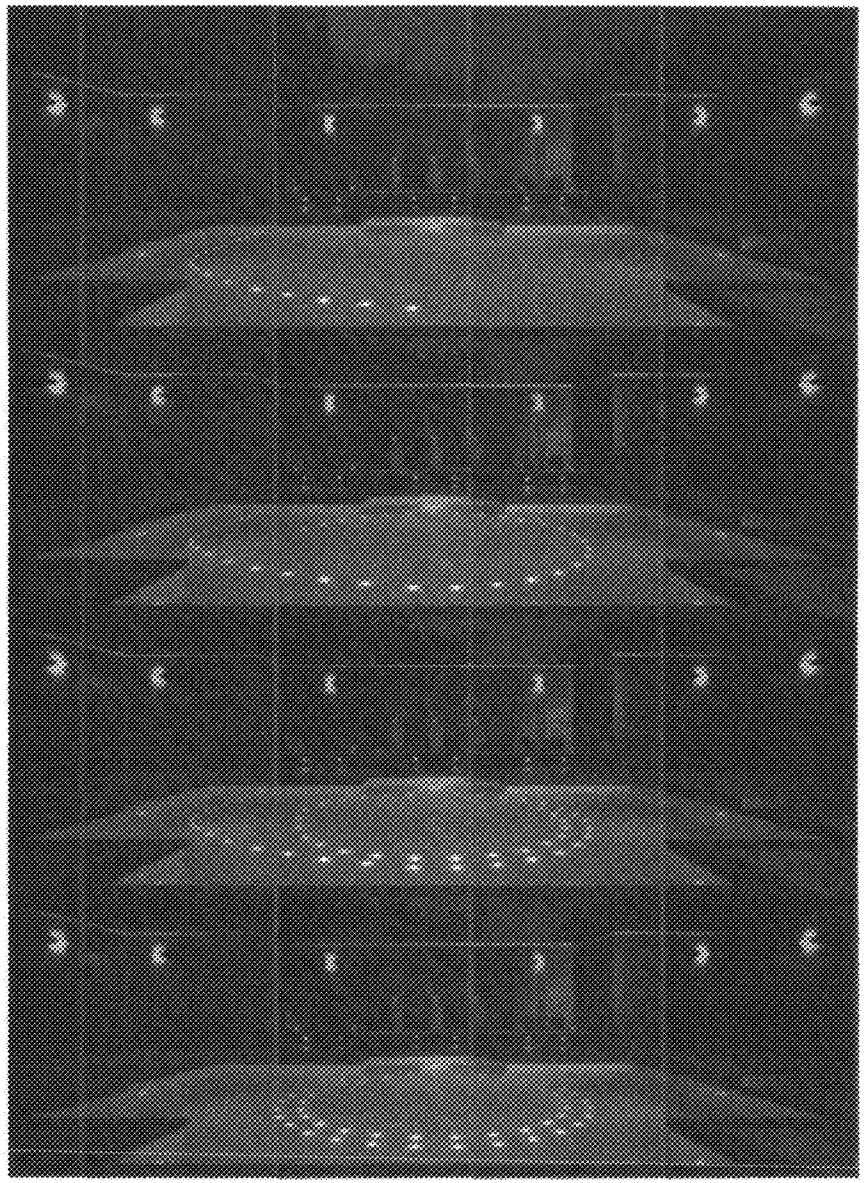
FIG. 6A
FIG. 6B
FIG. 6C
FIG. 6D
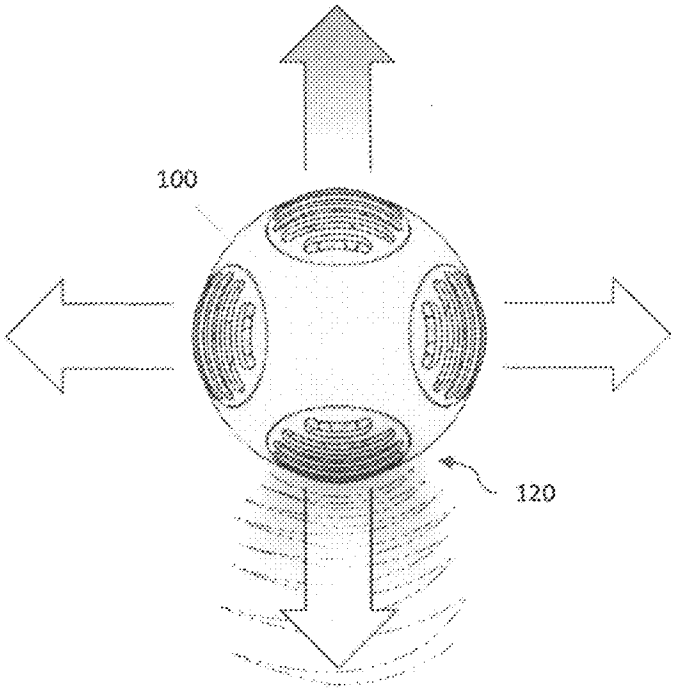
FIG. 5

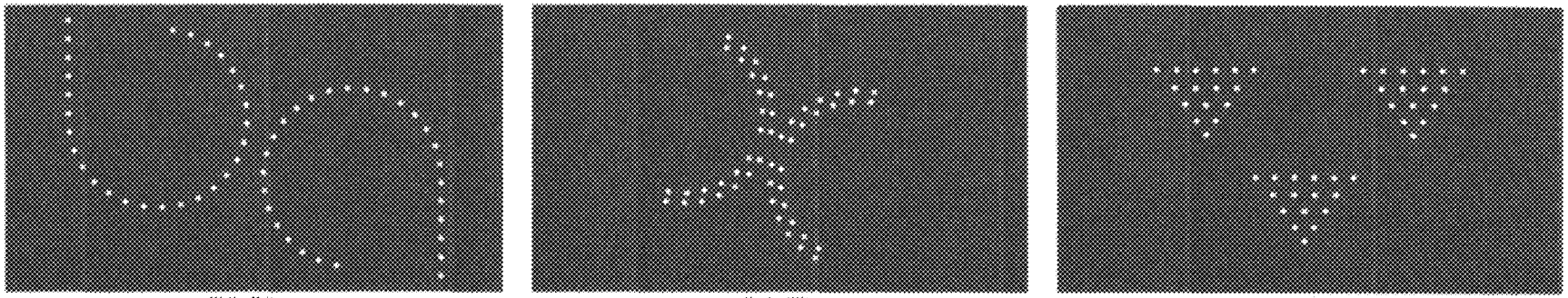
FIG. 7A
FIG. 7B
FIG. 7C
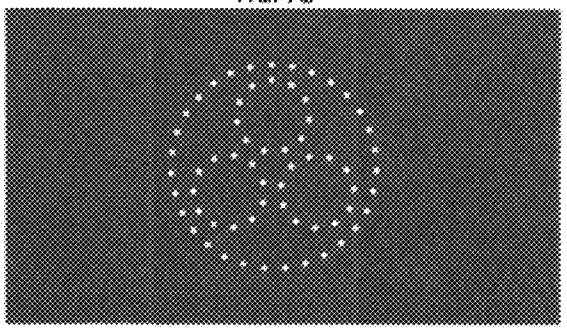
FIG. 7D
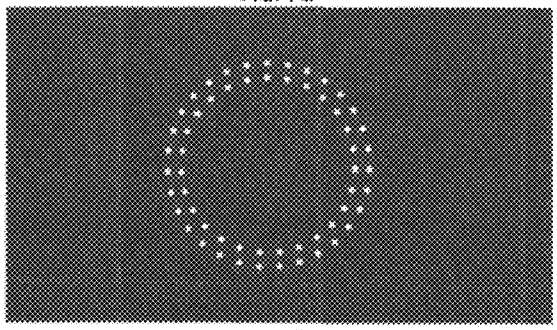
FIG. 7E
FIG. 7F
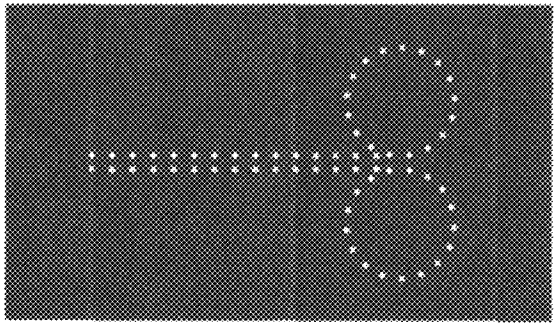
FIG. 7G
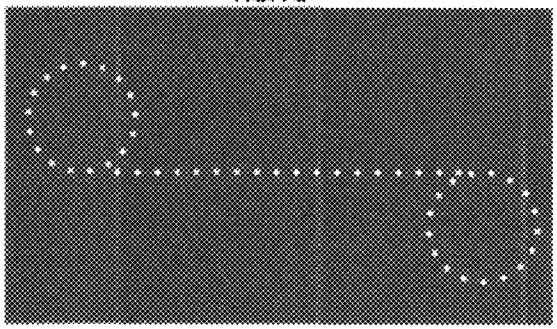
FIG. 7H
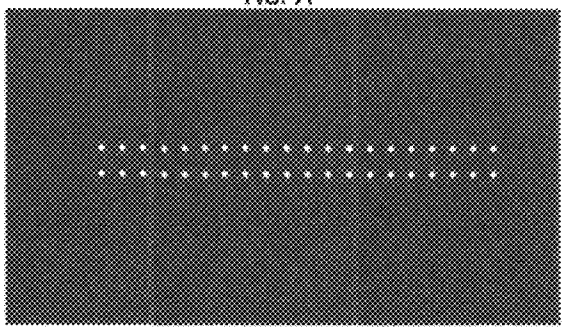
FIG. 7I

UNDERWATER LIGHT DISPLAY DEVICE WITH PROPULSION

CROSS REFERENCE TO RELATED APPLICATIONS

This application is a continuation of U.S. application Ser. No. 15/438,630 filed on Feb. 21, 2017, which claimed priority to U.S. Provisional Application No. 62/297,786, filed Feb. 19, 2016. The foregoing applications are incorporated hereby by reference as if fully set forth herein.

FIELD OF THE INVENTION

The present invention generally relates to floating or underwater light displays, including wireless floating or underwater light display devices and systems, and a system and method for controlling such displays.

BACKGROUND OF THE INVENTION

Various types of underwater and floating light displays exist. Oftentimes, the light display is located in a reservoir having a floor and walls. In certain existing systems, before the reservoir is filled with water, a network of underwater light display devices may be embedded in or attached to the bottom or walls of the reservoir. These may include the underwater light display devices themselves, as well as supporting lines such as electrical lines. Alternatively, some existing light displays float on the surface of the water in a reservoir. They may be free floating or tethered to an underwater control portion.

These existing underwater and floating light display devices may provide visual effects, but if they are fixed to the bottom or walls of the water reservoir, free floating in the reservoir or tethered, there is some limitation on the variety of visual effects they can produce. For example, fixed underwater light display devices typically cannot provide the appearance of a chain of lights moving into various geometrical patterns or a cluster of lights moving in a naturalistic flowing or swarming pattern reminiscent of organic phenomena such as fireflies or bioluminescence.

Accordingly, there is a need for a floating underwater light display device for use in a light display system that includes one or more floating or underwater light display devices that are wirelessly maneuverable about a display reservoir to provide unique visual displays. There is also a need for a floating or underwater light display device comprising a light and a multidirectional propulsion system. There is also a need for a floating underwater light display device that is capable of being controlled wirelessly.

SUMMARY OF THE INVENTION

In an aspect of the current invention, a floating or underwater light display system is described that includes one or more light display devices that are wirelessly and remotely controlled within a display reservoir to provide unique visual displays. A plurality of light display devices may be wirelessly controlled by commands received via one or more control hub. The control hub may receive commands via a control panel. The system may be operated by computer program or mobile application, such as an application on a tablet or mobile phone. Alternatively, the system may be manually controlled.

The light display device may be maneuvered in selected, choreographed sequences, which may include varying the location, direction, speed, light color, light brightness and other properties of each of the light display devices. A plurality of such light display devices may be wirelessly and remotely controlled to provide various visual displays. For example, the display devices may be controlled to form geometrical patterns and/or naturalistic patterns giving the impression of organic phenomena such as swarming fireflies, bioluminescent creatures and the like.

In another aspect of the current invention, a floating or underwater light display device is described that comprises a light, a multi-directional propulsion system and control electronics. The light display device is preferably free moving, i.e., not dependent on wires, cables, tracks and the like, and wirelessly controllable. It may also include one or more rechargeable battery packs. It is capable of receiving a data stream including commands and acting on the commands as appropriate, for example, by moving to a new location, adjusting its speed, light color, light brightness and other properties.

In another aspect of the current invention, a floating or underwater light display device is described that may be wirelessly, remotely controlled and/or operated via a control hub. Alternatively, the devices and system may be controlled from devices such as a phone, tablet or other device.

BRIEF DESCRIPTION OF THE DRAWINGS

Embodiments of the present invention will now be described, by way of example only, with reference to the following drawings.

FIG. 5 is a bottom view of a floating or underwater light display device illustrating the potential for multi-directional movement.

FIGS. 6A-6D are a series of pictures illustrating an example of how the light display devices may be controlled to form a visual light display.

FIGS. 7A-7I illustrate examples of various visual light displays which may be provided by the light display system of the present invention.

DETAILED DESCRIPTION OF THE PREFERRED EMBODIMENTS

Figure 1:
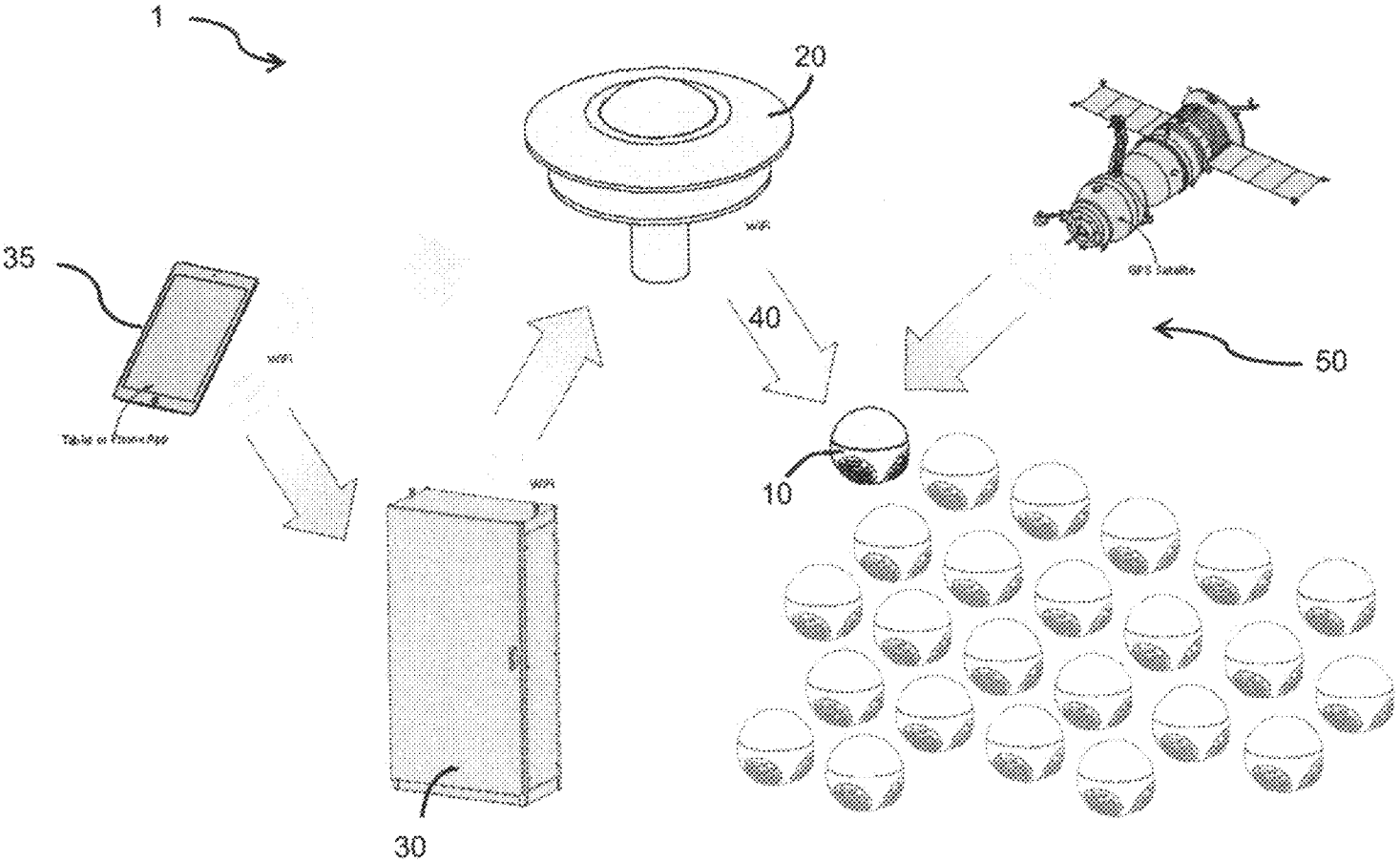
FIG. 1 is a system view of a floating or underwater light display system.

The current invention is now described with reference to the figures. Where the same or similar components appear in more than one figure, they are identified by the same or similar reference numeral. The invention is described herein with reference to water. However, the system of the current invention may be used with other liquids and combinations thereof, and such uses are within the scope of the invention.

Light display system 1 of the current invention is illustrated in FIG. 1 and may provide various visual light displays within a display pool or reservoir. System 1 may include devices that float at or near the surface of the water and/or that may be located underwater. As such, the current invention includes both scenarios, and the use of the term underwater is not meant to be limiting unless expressly stated as such. Light display system 1 may include one or more light display devices or pods 10 which may float and move along or near a surface of water or move underwater, and which may be remotely controlled by one or more control hub(s) 20. As shown in FIG. 1, a single control hub 20 may remotely control one or more light display devices 10. For example, control hub 20 may remotely control twenty (20) or some other number of light display devices 10. In another embodiment, light display system 1 may include a plurality of control hubs 20, each of which may remotely control a plurality of light display devices 10.

Display system 1 may also include control panel 30 which may remotely control the plurality of light display devices 10 via the appropriate control hub(s) 20. As shown, the communication between control panel 30, hub(s) 20 and pods or display devices 10 may occur through WiFi or other appropriate wireless network protocol.

As illustrated in FIG. 1, display system 1, may be operated by computer program or mobile application, such as an application on tablet or mobile phone 35 or other device. In this embodiment, a user may communicate via his or her device 35 with the control panel 30 and send commands to pods 10 though appropriate control hub(s) 20. Alternatively, the user may communicate directly with control hub 20 to send commands to pods 10.

As noted above, control hub 20 may send out a data stream 40, for example, over a WiFi network. The data stream may include, for example, device IDs, position commands and other commands to control the direction, speed or other aspects of devices 10. In a preferred embodiment, light display devices or pods 10 may receive a unique position command, compare it to its current position as determined by a GPS tracking system 50, and then move to its new position as appropriate. All or some number of devices 10 in system 1 may involve GPS tracking.

Other controls may be also communicated via data stream 40. For example, commands concerning timing and/or speed, light color, brightness and/or saturation may also be provided by data stream 40. It is preferred that these commands result in enhanced visual displays.

Display system 1 may provide that each of the underwater light display devices 10 independently moves around the display reservoir. For example, system 1 may control pods or devices 10 so that they may move to any location within the display reservoir, even right up to edges and/or into corners or nooks. By independently controlling the plurality of light display devices 10, system 1 preferably provides numerous possibilities for creating unique visual light displays which are generally not possible with traditional light systems using fixed lights, or lights that are moveable only along lengths of cable, or tracks in fixed patterns.

Control hub 20 may include a battery charger, for example, an inductive charger. Pods or devices 10 may dock to or otherwise engage with the appropriate control hub 20 to recharge their batteries, for example, by an inductive charging.

The components of system 1 are preferably located to enhance the appearance of its environment. For example, control panel 30 may be located in an out of the way place so that it may be relatively concealed. However, control panel 30 is still preferably located so as to not disrupt its network connection. Hub(s) 20 may be located in a corner or inconspicuous place in the reservoir. However, where pods 20 are configured to be docked and charged by hub(s) 20, it is preferred that hub(s) are located to allow such docking.

With reference to FIGS. 2-5, an embodiment of light display device 10 is now more fully described. In a preferred embodiment, light display device 10 comprises pod 100. Pod 100 may have any shape and size suitable for moving about a given display reservoir. In general, pod 10 may travel underwater or at or near the water's surface. For example, a portion of pod 10 may protrude above the water's surface. Pod 100 may have a generally spherical shape, but other shapes may be used. In a preferred embodiment, pod 100 is sufficiently small so that it is capable of creating an impression of a natural phenomenon such as a firefly or bioluminescence. For example, pod 100 may have a circumference of about 2.5 inches. Regardless, other shapes and sizes are within the scope of the current invention.

As illustrated, pod 100 may include upper dome 102 and lower dome 104 which may join together to form housing 106 to contain various components of pod 100. Some components may be sealed from the water, while others may engage the water.

Pod 100 preferably houses light 110 which may provide the lighting effect for system 1. Light 110 may be any of various types of lights. In a preferred embodiment, light 110 comprises a light emitting diode (LED). In another form, light 110 may comprise an RGBW LED. Light 110 may be housed within upper dome 102, so that it and its associated electronics 150 may be sealed from the water. Regardless of the shape of pod 100, it is preferred that pod 100 have a low center of gravity so that light 110 remains upward. Upper dome 102 may be clear or some other configuration.

Figure 10:
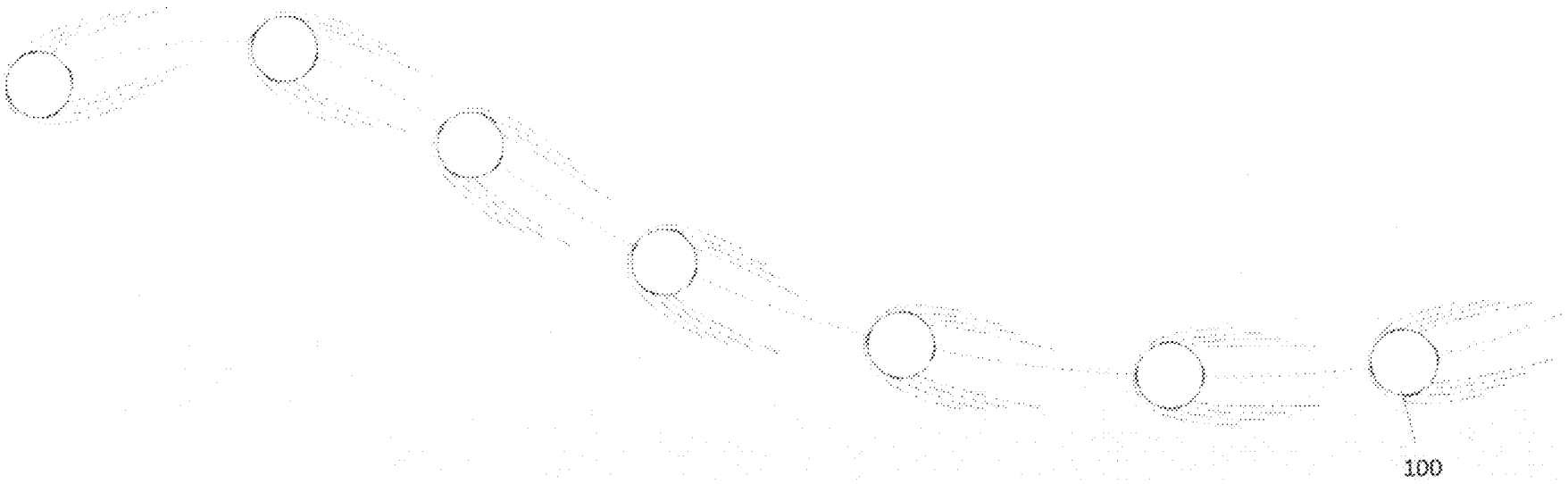
FIG. 10 illustrates an example of a multi-directional path for a light display device in accordance with the present invention.

Pod 100 preferably includes multi-directional propulsion system 120. As illustrated in FIGS. 5 and 10, for example, propulsion system 120 may advantageously allow pod 100 to be multi-directionally movable in an XY coordinate system. Pod 100 may also include other propulsion means to lower or raise pod 100 while underwater. As such, additional visual effects where light display device 10 submerges or nears the surface may be provided.

Propulsion system 120 may include one or more directional thrust motor(s) 121 coupled to propeller(s) 122 via propeller shaft(s) 124. As illustrated, for example, in FIG. 4, directional thrust motor 121 may be housed within the interior of pod 100, while propeller 122 may be positioned adjacent an exterior wall 126 of pod 100. Propeller shaft 124 may pass through a throughbore 128 in wall 126.

External wall 126 may include one or more propeller seats or recesses 130 that is sized and configured to receive a portion of propeller 122 and allow propeller 122 to rotate freely therein. Pod 100 may also include propeller grill 132 for enclosing propeller 122. Grill 132 may be sized and configured to securely fit into or engage propeller seat 130.

Figure 4:
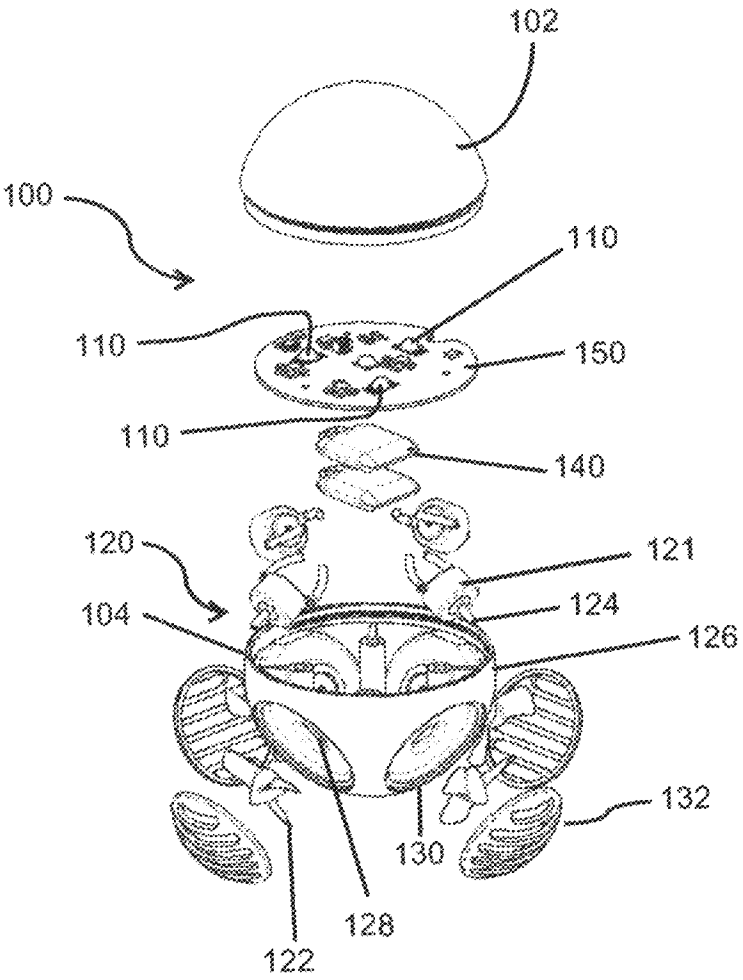
FIG. 4 is an exploded view of a floating or underwater light display device.
Figure 2:
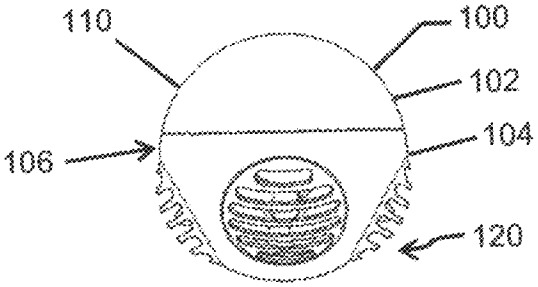
FIG. 2 is a side view of a floating or underwater light display device.
Figure 3:
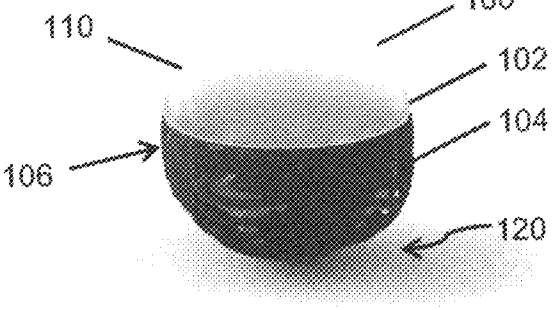
FIG. 3 is a perspective view of a floating or underwater light display device.
Figure 8A:
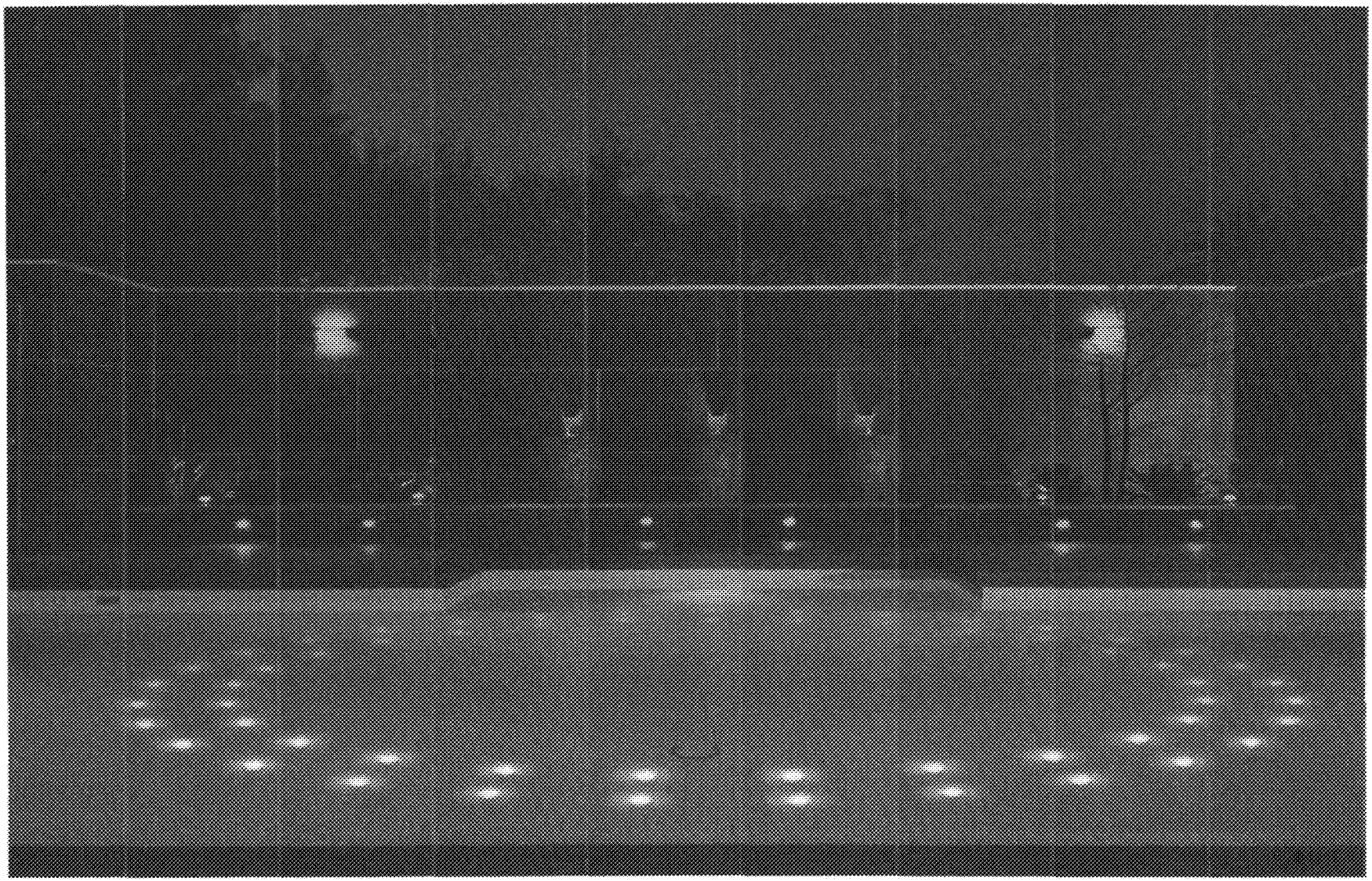
FIGS. 8A-8B show examples of various geometric pattern visual light displays which may be provided by the light display system of the present invention.
Figure 8B:
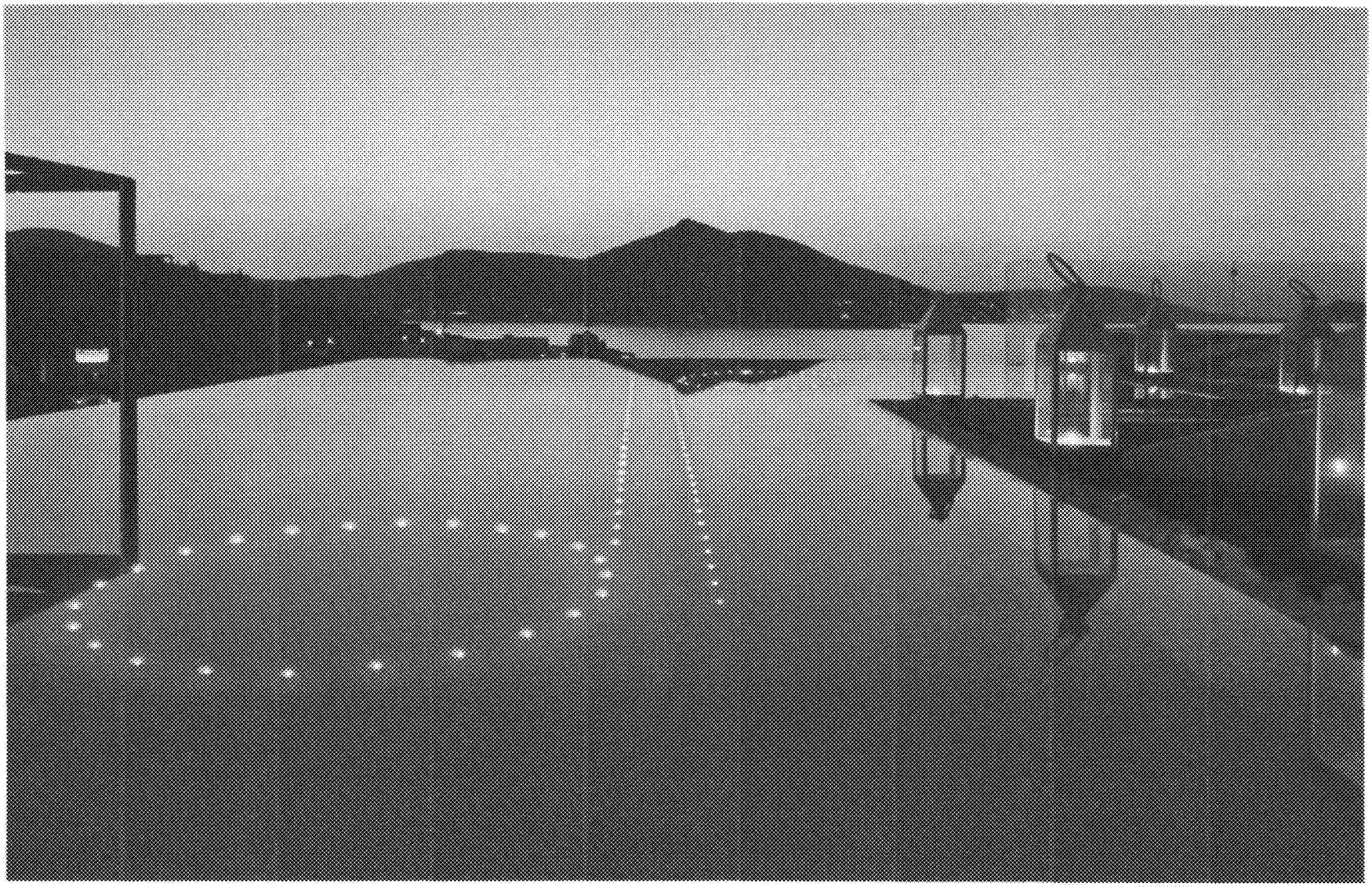

As shown in FIGS. 4 and 5, pod 100 may include a plurality of directional thrust motors 121 and propellers 122 to allow pod 100 to move in different directions. In a preferred embodiment, pod 100 includes four such directional thrust motors 121 and propellers 122 in each quadrant of pod 100. In this configuration, one or more propellers may be commanded to provide varying levels of thrust to control the direction of pod 100. One, two, three or some other number of propellers 122 may be used.

Pod 100 may include one or more battery pack(s) 140. Battery pack 140 may be rechargeable, including for example, by induction charging. In one form, pod 100 may include 2 or more battery packs 140 connected in series which may advantageously allow extended run times before the pod 100 must be docked for recharging or otherwise recharged.

Pod 100 may also include electronic control system 150 such as a printed circuit board (PCB). Electronic control system 150 may allow pod 100 to receive data stream 40 from control hub 20, for example, over a WiFi network. For example, electronic control system 150 may allow pod 100 to receive a unique position command via data stream 40, compare the position to its current position as determined by a GPS tracking system 50, and then cause pod 100 to move to its new position by engaging one or more directional thrust motors 120 and propellers 122 as appropriate.

Electronic control system 150 may receive and/or implement other commands via the data stream 40, including but not limited to, commands concerning timing and/or speed, light color, brightness, saturation and/or other properties.

As an alternative to the remote control described above, pod 100 may be preprogrammed and not rely on remotely internally provided commands. To this end, control system 150 may include software to control pod 100. In this embodiment, control system 150 may include an EEPROM that allows different control programs to be loaded to pod 100 to provide different displays.

It is preferred that electronics 150 be housed within upper dome 102 and sealed from the water. Alternatively, electronics 150 may be potted and exposed to the water. Batteries 140 may also be sealed or be water resistant or waterproof.

Lower dome 126 may also include a cleaning assembly (not shown) that may dispense cleaner through grills 132 to the water. In this manner, as pods 100 move about the pool or reservoir, they may provide a cleaning function.

It should be noted that the current invention is not limited to the design of pod 100 or light display device 10. That is, other types of propulsion systems to move device 10 beyond those disclosed herein may be used. Furthermore, devices 10 may be coupled to a track to guide their movement. For example, devices 10 may travel along tracks at or near the bottom or sides of the pool or reservoir.

Light displays that may be provided by the current invention are now further described with references to FIGS. 6A-D, 7A-I, 8A-B and 9A-C. The current invention is not limited to the types of displays shown therein since these are only examples. Instead, the current invention covers wireless control and/or preprogrammed internal control of the movement of devices 10 to provide various types of light displays that move about a display reservoir in unique patterns and/or sequences. To this end, it is preferred that system 1 controls devices or pods 100 to provide a choreography to convey a desired expression and/or to complement the surroundings. As noted above, this may include movement of devices 10 at or near the water's surface, or underwater. And movement of devices 10 may occur in the X-Y plane, or additionally in the Z-direction where devices 10 submerge and rise up.

Figure 9A:
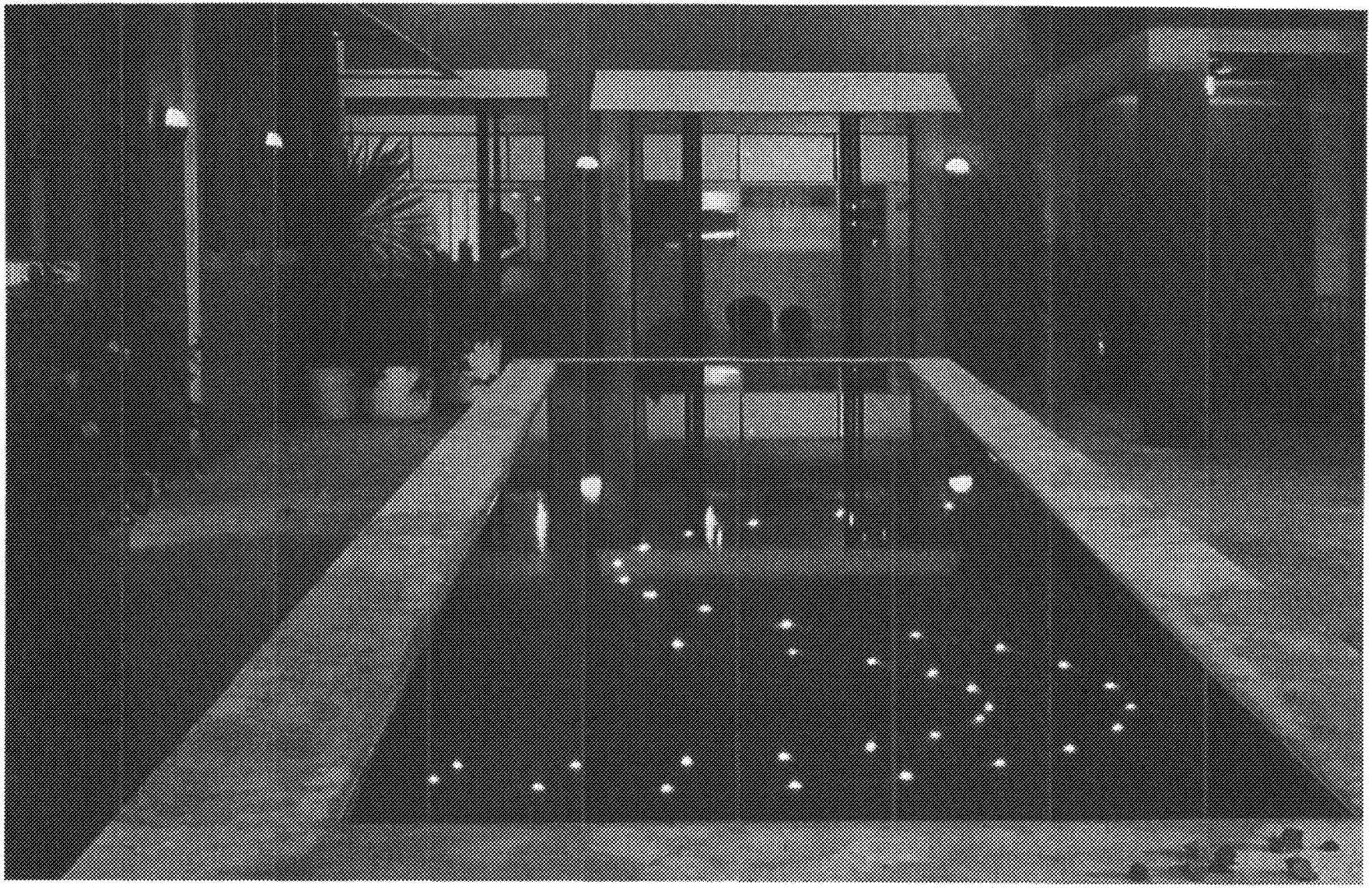
FIGS. 9A-9C show examples of various naturalistic pattern visual light displays which may be provided by the light display system of the present invention.
Figure 9B:
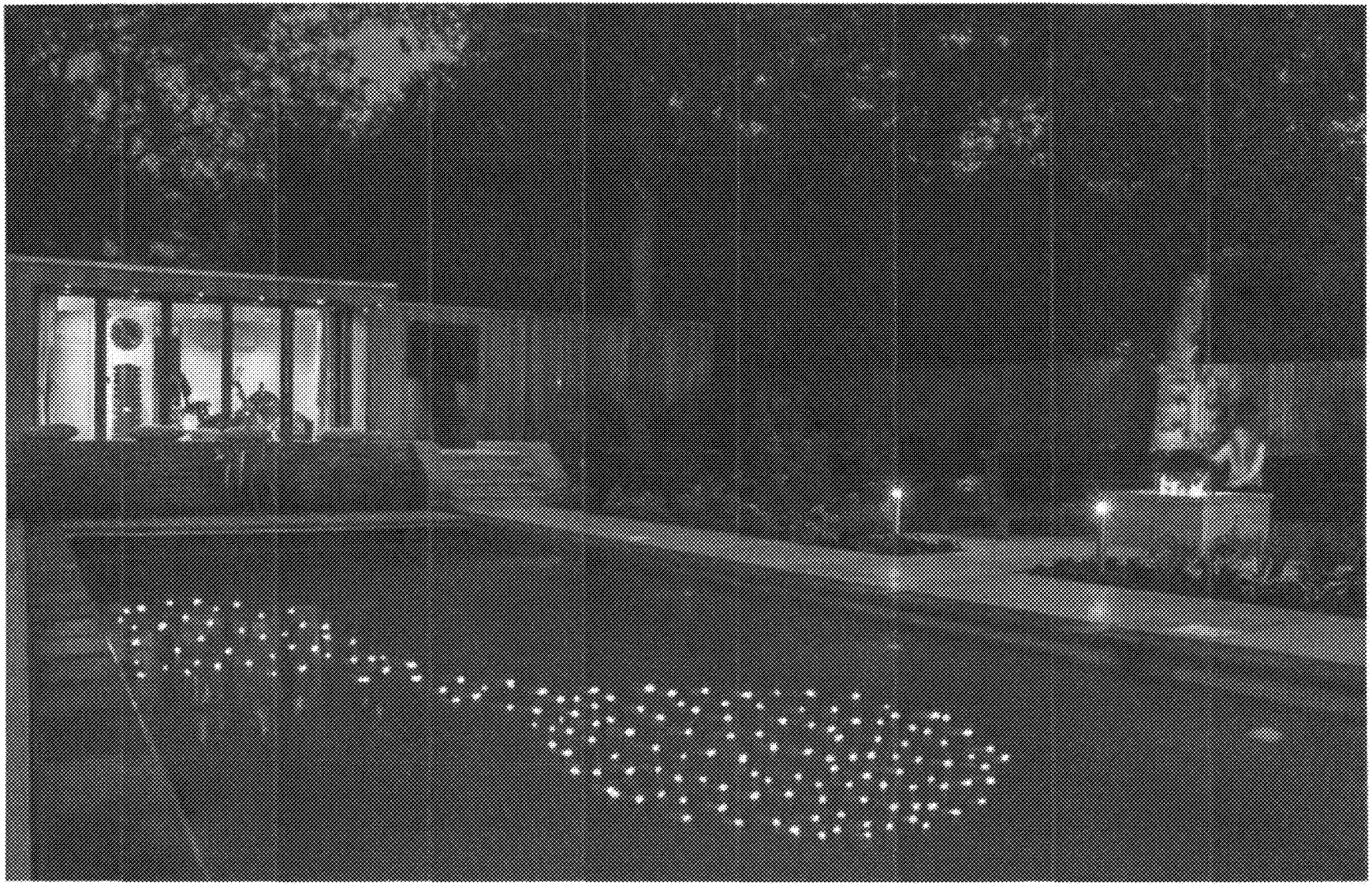
Figure 9C:
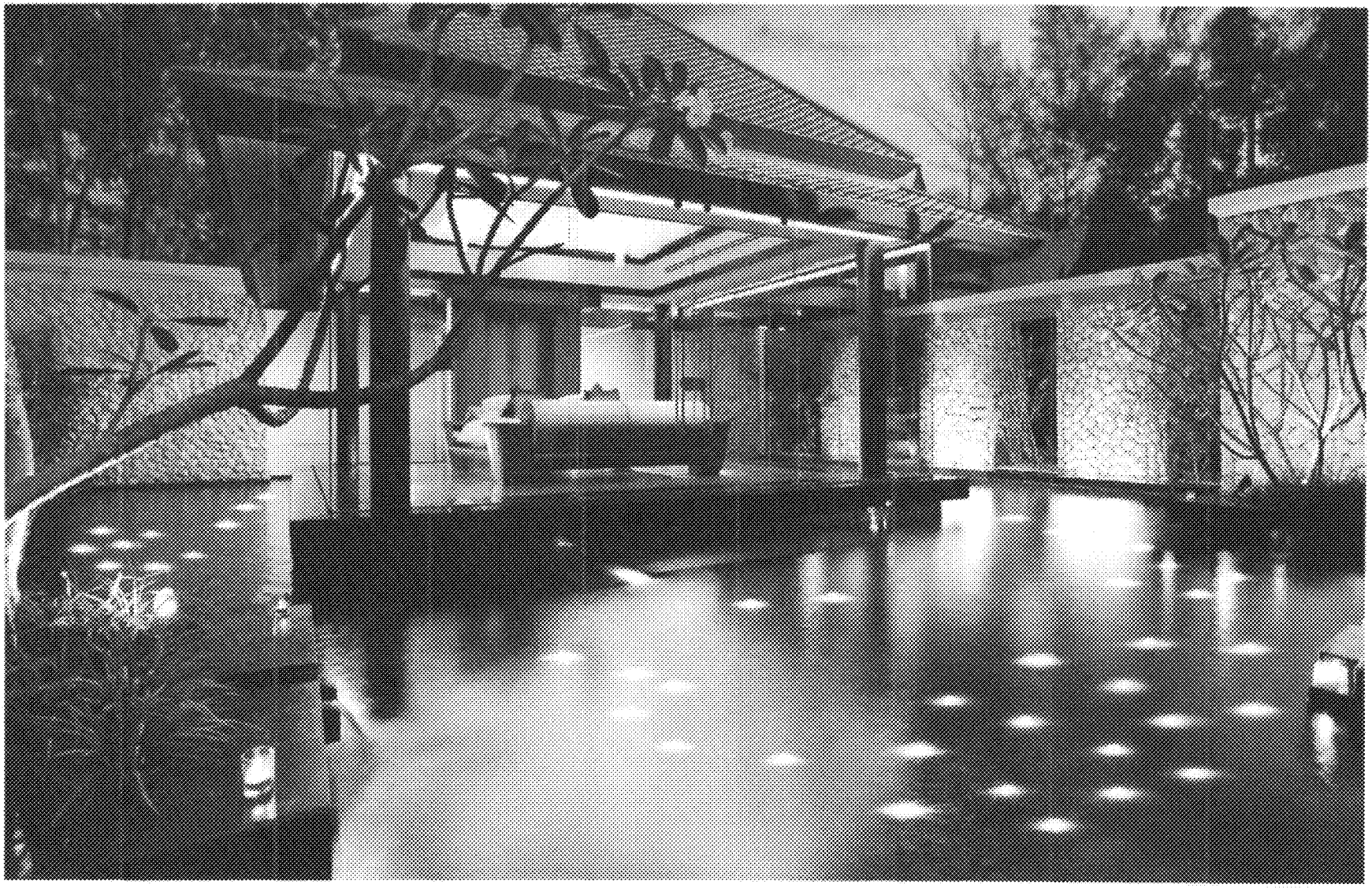

FIGS. 6A-D show a sequence whereby a plurality of pods 10 are controlled to move in a line and move into a concentric circle pattern. FIGS. 7A-I and 8A-B illustrate various geometric patterns that may be displayed by system 1. FIGS. 9A-C illustrate various alternative naturalistic or organic patterns that may be displayed by system 1 to create the impression of organic phenomena such as swarming fireflies or bioluminescent creatures. As noted above, the display system 1 of the current invention allows for virtually unlimited designs and/or movements of the pods 10 to provide unlimited display options. The wireless or internal preprogrammed control of devices 10 coupled with the multi-directional propulsion system 120 allow for displays and movements that are not obtainable with conventional light displays.

System 1 may be installed in various types of locations. For example, as shown in several of the figures, system 1 may be installed in a pool at a private residence. Alternatively, system 1 may be installed at commercial locations. Furthermore, system 1 may be added to existing water and/or light displays to further enhance such displays. In this scenario, pods 100 or devices 10 may be commanded to move, light and otherwise complement the expressions of the existing display. In any event, the pool, reservoir or other body of water or liquid may vary in size, shape and configuration.

It is preferred that system 1 is scalable so that more pods 100 or devices 10 may be added or deleted. To this end, the overall visual effect of system 1 may be modified as desired.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A light display system for use in a body of water or other liquid, comprising:

a first movable light device that is located in the body of water or other liquid, and that includes a first light, a first propulsion system and a first control system;

a second movable light device that is located in the body of water or other liquid, and that includes a second light, a second propulsion system and a second control system; and a user device that operates the light display system by sending a command that is communicated to the first movable light device to control one or more properties of the first movable light device, and is communicated to the second movable light device to control one or more properties of the second movable light device.

2. The light display system of claim 1, further comprising:

a control hub that is configured to receive the command from the user device, and in response to the command, is configured to communicate a first command to the first movable light device to control one or more properties of the first movable light, and is configured to communicate a second command to the second movable light device to control one or more properties of the second movable light.

3. The light display system of claim 2, wherein the first command and/or the second command is a direction command.

4. The light display system of claim 2, wherein the first command and/or the second command is a location command.

5. The light display system of claim 2, wherein the first command and/or the second command is a speed command.

6. The light display system of claim 2, wherein the first command and/or the second command is a light color command.

7. The light display system of claim 2, wherein the first command and/or the second command is a light brightness command.

8. The light display system of claim 1, wherein the user device comprises a tablet or a mobile phone.

9. The light display system of claim 8, wherein the user device comprises a tablet or mobile phone containing an app to operate the light display system.

10. The light display system of claim 1, wherein the command from the user device results in further comprising:

a control hub that communicates with the user device and that sends the at least one command to the at least one movable light device.

11. The light display system of claim 1, further comprising:

a control panel that is configured to receive the command from the user device, and in response to the command, is configured to communicate a first command to the first movable light device to control one or more properties of the first movable light, and is configured to communicate a second command to the second movable light device to control one or more properties of the second movable light.

12. The light display system of claim 1, further comprising a GPS tracking system for providing current location data for the first movable light device and the second movable light device, wherein the command from the user device uses the current location data to control the location property of the first movable device and to control the location property of the second movable light device.

13. A light display system for use in a body of water or other liquid, comprising:

a first movable light device that is located in the body of water or other liquid, and that includes a first light, a first propulsion system that is configured to move the first movable light device multi-directionally and a first control system;

a second movable light device that is located in the body of water or other liquid, and that includes a second light, a second propulsion system that is configured to move the second light display device multi-directionally and a second control system;

an electronic control system that implements at least one command to control one or more properties of the first movable light device and the second movable light device; and a user device that operates the light display system by sending a command to the electronic control system.

14. The light display system of claim 13, further comprising a recharging dock to which the first movable light device and the second movable light device may be directed for recharged of batteries contained in the first movable light device and the second movable light device.

15. The light display system of claim 13, wherein the first light and the second light each comprise an LED.

16. The light display system of claim 13, wherein the first propulsion system and the second propulsion system each comprise a propulsion motor operably connected to a respective propeller.

17. The light display system of claim 13, wherein the first propulsion system and the second propulsion system each comprise four propulsion motors, each of which is operably connected to a respective propeller.

18. The light display system of claim 13, wherein the electronic control system comprises a PCB.

19. The light display system of claim 13, wherein the first movable light device and the second movable light device each includes a housing that contains the light, the propulsion system and the electronic control system.

20. The light display system of claim 19, wherein each housing is spherical.

* * * * *